US009910375B2

(12) United States Patent
Sekiguchi et al.

(10) Patent No.: US 9,910,375 B2
(45) Date of Patent: Mar. 6, 2018

(54) YELLOW TONER AND METHOD FOR PRODUCING THE SAME

(71) Applicant: CANON KABUSHIKI KAISHA, Tokyo (JP)

(72) Inventors: Takeshi Sekiguchi, Kawasaki (JP); Shosei Mori, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/163,546

(22) Filed: May 24, 2016

(65) Prior Publication Data

US 2016/0349647 A1 Dec. 1, 2016

(30) Foreign Application Priority Data

May 27, 2015 (JP) ..... 2015-107873

(51) Int. Cl.
*G03G 9/09* (2006.01)
*G03G 9/08* (2006.01)
*G03G 15/08* (2006.01)

(52) U.S. Cl.
CPC ..... *G03G 9/091* (2013.01); *G03G 9/0806* (2013.01); *G03G 9/0924* (2013.01); *G03G 15/08* (2013.01)

(58) Field of Classification Search
CPC ..... G03G 9/091; G03G 9/0924
See application file for complete search history.

(56) References Cited

U.S. PATENT DOCUMENTS 4,514,226 A * 4/1985 Leoffler ..... C09B 29/0003 106/31.48
5,151,506 A * 9/1992 Bach ..... C09B 29/363 534/772
5,543,259 A * 8/1996 Schwarz ..... G03G 9/122 430/108.21
7,014,969 B2 * 3/2006 Yachi ..... G03G 9/08797 423/335
7,091,261 B1 * 8/2006 Matsuzaki ..... C09B 25/00 523/160
7,094,277 B2 * 8/2006 Schut ..... C09B 43/11 106/31.27
7,504,488 B2 * 3/2009 Toyoda ..... C09B 29/0007 106/31.48
7,833,685 B2 * 11/2010 Tanaka ..... C09B 29/0003 430/108.23
8,211,606 B2 * 7/2012 Murai ..... B41M 5/388 106/31.47
9,323,168 B2 * 4/2016 Mori ..... G03G 9/08708
9,580,576 B2 * 2/2017 Mori ..... G03F 7/004
2010/0035171 A1 * 2/2010 Watanabe ..... C09B 29/363 430/108.23
2015/0378273 A1 * 12/2015 Mori ..... G03G 9/0806 430/108.23
2016/0349646 A1 * 12/2016 Yoshida ..... G03G 9/091

FOREIGN PATENT DOCUMENTS

GB 1360749 A * 7/1974 ..... C09B 29/3626
JP 1989-253759 A 10/1989
(Continued)

OTHER PUBLICATIONS

English language machine translation of JP 03-042676 (Feb. 1991).*
(Continued)

*Primary Examiner* — Christopher D Rodee
(74) *Attorney, Agent, or Firm* — Canon U.S.A., Inc. IP Division

(57) ABSTRACT

A yellow toner is provided. The yellow toner includes toner particles containing a binder resin and a colorant containing at least one compound selected the group consisting of compounds given by the following formulae (1), (2), and (3) for used in a recording method such as an electrophotographic method, an electrostatic recording method, a magnetic recording method, or a toner jet method, and to a method for producing the toner:

(1)

(2)

(3)

wherein in the formulae (1), (2), and (3) the R groups are as set forth in the specification.

10 Claims, No Drawings

(56) References Cited

FOREIGN PATENT DOCUMENTS

| | | | | | |
|---|---|---|---|---|---|
| JP | 03042676 | A | * | 2/1991 | |
| JP | 6-59510 | A | | 3/1994 | |
| JP | 2612294 | B2 | | 5/1997 | |
| JP | 11-334204 | A | | 12/1999 | |
| JP | 2011-257706 | A | | 12/2011 | |
| JP | 2012-067229 | A | | 4/2012 | |
| JP | 2013-209638 | A | | 10/2013 | |
| JP | 2013-214058 | A | | 10/2013 | |
| WO | 95/034846 | A1 | | 12/1995 | |
| WO | 08/069045 | A1 | | 6/2008 | |
| WO | WO 2013133449 | A1 | * | 9/2013 | ..... G03G 9/08708 |

OTHER PUBLICATIONS

Duke, C.B.; Noolandi, J.; Thieret, T. The surface science of xerography. Surface Science (2002), 500, pp. 1005-1023.*

* cited by examiner

YELLOW TONER AND METHOD FOR PRODUCING THE SAME

BACKGROUND OF THE INVENTION

Field of the Invention

The present disclosure relates to a yellow toner used in a recording method such as an electrophotographic method, an electrostatic recording method, a magnetic recording method, or a toner jet method, and to a method for producing the toner.

Description of the Related Art

The demand for higher-quality color images is increasing. Color copy machines and color printers generally form images on a recording medium by the method of developing color toners of Y (yellow), M (magenta), C (cyan), and Bk (black). Accordingly, it is desirable that the performance of the colorant in the toners be improved.

Exemplary colorants used in yellow toners include compounds having a structure or a skeleton of isoindolinone, quinophthalone, isoindoline, anthraquinone, anthrone, xanthene, or pyridoneazo.

Japanese Patent Laid-Open No. 1989-253759 discloses a toner containing a yellow colorant having a pyridoneazo skeleton. The yellow pigment is easy to fuse and mix, allows images to be stably formed even though development is repeated, and exhibits high light fastness.

Also, International Publication Nos. WO 95/34846 and WO 08/069045, Japanese Patent Laid-Open Nos. 2013-214058, 6-59510, and 2011-257706, and Japanese Patent No. 2612294 disclose yellow colorants, each having a specific substituent or a substituent at a specific position.

SUMMARY OF THE INVENTION

The present inventors have found through their study that the yellow toners disclosed in these patent documents are good in color tone and tinting strength, but should be improved in storage stability, such as blocking resistance property and environmental stability of chargeability, and in light fastness.

The present disclosure provides a yellow toner superior in storage stability, such as blocking resistance property and environmental triboelectric stability, and in light fastness, and a method for producing the yellow toner.

According to an aspect of the present disclosure, there is provided a yellow toner comprising a toner particle containing a binder resin and a colorant. The colorant contains at least one compound selected from the group consisting of a compound expressed by the following formula (1), a compound expressed by the following formula (2), and a compound expressed by the following formula (3):

(1)

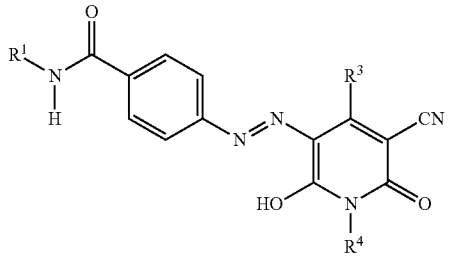

-continued (2)

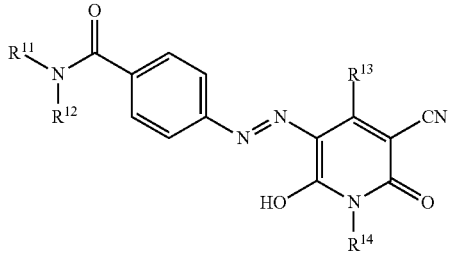

(3)

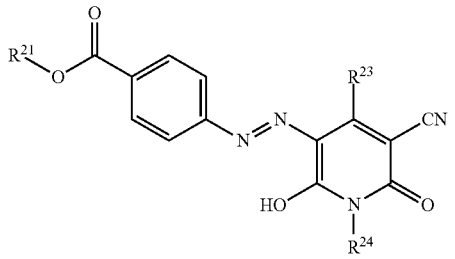

In formulas (1) to (3), $R^1$, $R^{11}$, $R^{12}$, and $R^{21}$ each represent an alkyl group having a carbon number of 3 or more. $R^3$, $R^{13}$, and $R^{23}$ each represent an alkyl group. $R^4$, $R^{14}$, and $R^{24}$ each represent a linear alkyl group having a carbon number of 3 or more.

According to another aspect of the present disclosure, a method for producing the yellow toner is provided. The method includes one of the following processes (i) and (ii):

(i) preparing a suspension by dispersing in an aqueous medium a polymerizable monomer composition containing the colorant and a polymerizable monomer capable of producing the binder resin, and polymerizing the polymerizable monomer to produce the toner particle; and (ii) suspending a solution containing the colorant and the binder resin in an aqueous medium to prepare a suspension, and granulating the suspension to form the toner particle.

According to still another aspect of the present disclosure, there is provided a method for producing the yellow toner, including mixing a dispersion liquid produced by emulsifying the binder resin for dispersion and a dispersion liquid of the colorant, and forming the toner particle by aggregation and heat fusing.

According to further aspect of the present disclosure, there is provided a method for producing the yellow toner, including kneading a resin composition containing the binder resin and the colorant, and pulverizing the resin composition to form the toner particle.

Further features of the present disclosure will become apparent from the following description of exemplary embodiments.

DESCRIPTION OF THE EMBODIMENTS

The subject matter of the present disclosure will be further described in detail using exemplary embodiments.

The yellow toner according to an embodiment of the present disclosure is made up of toner particles containing a binder resin and a colorant. The colorant contains at least one compound selected from the group consisting of a compound expressed by the following formula (1), a compound expressed by the following formula (2), and a compound expressed by the following formula (3).

(1)

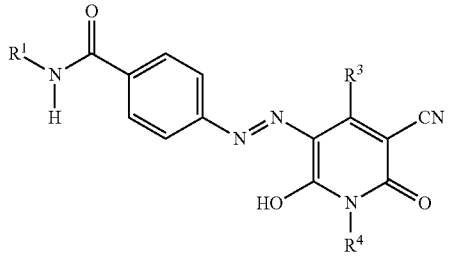

(2)

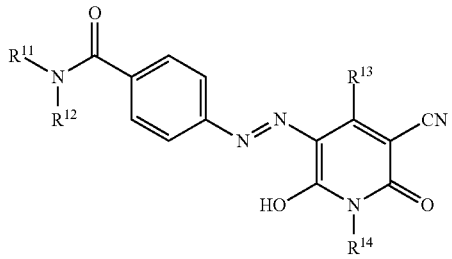

(3)

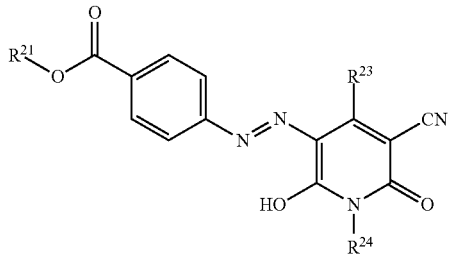

In formulas (1) to (3), $R^1$, $R^{11}$, $R^{12}$, and $R^{21}$ each represent an alkyl group having a carbon number of 3 or more. $R^3$, $R^{13}$, and $R^{23}$ each represent an alkyl group. $R^4$, $R^{14}$, and $R^{24}$ each represent a linear alkyl group having a carbon number of 3 or more.

Examples of the alkyl group having a carbon number of 3 or more represented by $R^1$, $R^{11}$, $R^{12}$, and $R^{21}$ include linear, branched, or cyclic primary to tertiary alkyl groups having a carbon number in the range of 1 to 16, such as n-propyl, isopropyl, n-butyl, sec-butyl, tert-butyl, n-octyl, cyclohexyl, and 2-ethylhexyl. Advantageously, the carbon number of the alkyl group is in the range of 3 to 8.

Examples of the alkyl group represented by $R^3$, $R^{13}$, and $R^{23}$ include linear or branched primary to tertiary alkyl groups having a carbon number in the range of 1 to 16, such as methyl, ethyl, n-propyl, n-butyl, sec-butyl, and n-octyl. Advantageously, the carbon number of the alkyl group is in the range of 1 to 8.

Examples of the linear alkyl group represented by $R^4$, $R^{14}$, and $R^{24}$ include linear alkyl groups having a carbon number of 3 or more, such as n-propyl, n-butyl, n-pentyl, n-hexyl, and n-octyl. Advantageously, the carbon number of the alkyl group is in the range of 3 to 8.

When $R^1$, $R^{11}$, $R^{12}$, and $R^{21}$ are each the n-octyl or the 2-ethylhexyl group, the colorant exhibits good light fastness.

The compound expressed by formula (1) can be synthesized with reference to the known process disclosed in Japanese Patent Laid-Open No. 2012-067229.

Although exemplary compounds expressed by formulas (1) to (3) are shown in the following tables, the compound used in the colorant is not limited to the compounds shown in the tables.

(1)

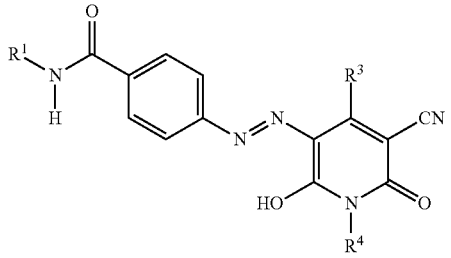

TABLE 1

| Compound | $R^1$ | $R^3$ | $R^4$ |
|---|---|---|---|
| (1-1) | n-Propyl | Methyl | n-Propyl |
| (1-2) | n-Propyl | Ethyl | n-Butyl |
| (1-3) | n-Propyl | n-Propyl | n-Butyl |
| (1-4) | n-Propyl | n-Butyl | n-Propyl |
| (1-5) | n-Propyl | n-Butyl | n-Butyl |
| (1-6) | n-Propyl | sec-Butyl | n-Butyl |
| (1-7) | n-Propyl | n-Octyl | n-Hexyl |
| (1-8) | Isopropyl | Methyl | n-Octyl |
| (1-9) | Isopropyl | Ethyl | n-Butyl |
| (1-10) | Isopropyl | n-Propyl | n-Propyl |
| (1-11) | Isopropyl | sec-Butyl | n-Pentyl |
| (1-12) | Isopropyl | n-Octyl | n-Pentyl |
| (1-13) | n-Butyl | Methyl | n-Octyl |
| (1-14) | n-Butyl | Ethyl | n-Hexyl |
| (1-15) | n-Butyl | Ethyl | n-Octyl |
| (1-16) | n-Butyl | n-Propyl | n-Octyl |
| (1-17) | n-Butyl | n-Butyl | n-Pentyl |
| (1-18) | n-Butyl | sec-Butyl | n-Octyl |
| (1-19) | n-Butyl | n-Octyl | n-Propyl |
| (1-20) | sec-Butyl | Methyl | n-Butyl |
| (1-21) | sec-Butyl | Ethyl | n-Pentyl |
| (1-22) | sec-Butyl | n-Butyl | n-Butyl |
| (1-23) | tert-Butyl | Methyl | n-Butyl |
| (1-24) | tert-Butyl | n-Butyl | n-Butyl |
| (1-25) | n-Octyl | Methyl | n-Propyl |
| (1-26) | n-Octyl | Methyl | n-Butyl |
| (1-27) | n-Octyl | Ethyl | n-Butyl |
| (1-28) | n-Octyl | n-Propyl | n-Butyl |
| (1-29) | n-Octyl | n-Butyl | n-Propyl |
| (1-30) | n-Octyl | n-Butyl | n-Butyl |
| (1-31) | n-Octyl | sec-Butyl | n-Butyl |
| (1-32) | n-Octyl | n-Octyl | n-Hexyl |
| (1-33) | Cyclohexyl | Methyl | n-Propyl |
| (1-34) | Cyclohexyl | Methyl | n-Butyl |
| (1-35) | Cyclohexyl | n-Propyl | n-Butyl |
| (1-36) | Cyclohexyl | n-Butyl | n-Pentyl |
| (1-37) | Cyclohexyl | n-Octyl | n-Octyl |
| (1-38) | 2-Etylhexyl | Methyl | n-Propyl |
| (1-39) | 2-Etylhexyl | Methyl | n-Butyl |
| (1-40) | 2-Etylhexyl | Methyl | n-Hexyl |

TABLE 2

| | | | |
|---|---|---|---|
| (1-41) | 2-Etylhexyl | Methyl | n-Octyl |
| (1-42) | 2-Etylhexyl | Ethyl | n-Propyl |
| (1-43) | 2-Etylhexyl | Ethyl | n-Butyl |
| (1-44) | 2-Etylhexyl | Ethyl | n-Octyl |
| (1-45) | 2-Etylhexyl | n-Propyl | n-Butyl |
| (1-46) | 2-Etylhexyl | n-Butyl | n-Propyl |
| (1-47) | 2-Etylhexyl | n-Butyl | n-Butyl |
| (1-48) | 2-Etylhexyl | sec-Butyl | n-Propyl |
| (1-49) | 2-Etylhexyl | sec-Butyl | n-Butyl |
| (1-50) | 2-Etylhexyl | n-Octyl | n-Propyl |
| (1-51) | 2-Etylhexyl | n-Octyl | n-Butyl |

Tables 1 and 2 show examples of the compound expressed by formula (1). Among these (1-26), (1-30), (1-38), (1-39), (1-41), (1-47), and (1-50) are advantageous.

(2)

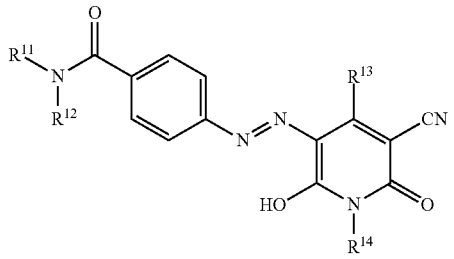

TABLE 3

| Compound | $R^{11}$ | $R^{12}$ | $R^{13}$ | $R^{14}$ |
|---|---|---|---|---|
| (2-1) | n-Propyl | n-Propyl | Methyl | n-Propyl |
| (2-2) | n-Propyl | n-Butyl | Ethyl | n-Propyl |
| (2-3) | n-Propyl | n-Propyl | n-Propyl | n-Propyl |
| (2-4) | n-Propyl | n-Propyl | n-Propyl | n-Butyl |
| (2-5) | n-Propyl | n-Propyl | n-Butyl | n-Propyl |
| (2-6) | n-Propyl | n-Propyl | n-Octyl | n-Hexyl |
| (2-7) | Isopropyl | Isopropyl | Methyl | n-Propyl |
| (2-8) | Isopropyl | Isopropyl | Methyl | n-Butyl |
| (2-9) | Isopropyl | Isopropyl | Ethyl | n-Butyl |
| (2-10) | Isopropyl | Isopropyl | n-Propyl | n-Octyl |
| (2-11) | Isopropyl | Isopropyl | n-Butyl | n-Propyl |
| (2-12) | Isopropyl | Isopropyl | n-Octyl | n-Butyl |
| (2-13) | n-Octyl | n-Butyl | Methyl | n-Octyl |
| (2-14) | n-Butyl | n-Butyl | Ethyl | n-Hexyl |
| (2-15) | n-Butyl | n-Butyl | n-Propyl | n-Butyl |
| (2-16) | n-Butyl | n-Butyl | n-Butyl | n-Propyl |
| (2-17) | n-Butyl | n-Butyl | n-Butyl | n-Butyl |
| (2-18) | n-Butyl | n-Butyl | n-Butyl | n-Pentyl |
| (2-19) | n-Butyl | n-Butyl | sec-Butyl | n-Butyl |
| (2-20) | n-Butyl | n-Butyl | n-Octyl | n-Pentyl |
| (2-21) | sec-Butyl | tert-Butyl | Methyl | n-Butyl |
| (2-22) | sec-Butyl | sec-Butyl | Ethyl | n-Pentyl |
| (2-23) | sec-Butyl | sec-Butyl | n-Butyl | n-Butyl |
| (2-24) | tert-Butyl | tert-Butyl | Methyl | n-Butyl |
| (2-25) | tert-Butyl | tert-Butyl | n-Butyl | n-Butyl |
| (2-26) | n-Octyl | n-Octyl | Methyl | n-Propyl |
| (2-27) | n-Octyl | n-Octyl | Methyl | n-Butyl |
| (2-28) | n-Octyl | n-Octyl | Methyl | n-Pentyl |
| (2-29) | n-Octyl | n-Octyl | Methyl | n-Hexyl |
| (2-30) | n-Octyl | n-Octyl | Methyl | n-Octyl |
| (2-31) | n-Octyl | n-Octyl | Ethyl | n-Propyl |
| (2-32) | n-Octyl | n-Octyl | Ethyl | n-Butyl |
| (2-33) | n-Octyl | n-Octyl | Ethyl | n-Octyl |
| (2-34) | n-Octyl | 2-Etylhexyl | n-Propyl | n-Propyl |
| (2-35) | n-Octyl | n-Octyl | n-Propyl | n-Butyl |
| (2-36) | n-Octyl | n-Octyl | n-Propyl | n-Pentyl |
| (2-37) | n-Octyl | n-Octyl | n-Propyl | n-Octyl |
| (2-38) | n-Octyl | n-Octyl | n-Butyl | n-Propyl |
| (2-39) | n-Octyl | n-Octyl | n-Butyl | n-Butyl |
| (2-40) | n-Octyl | n-Octyl | n-Butyl | n-Pentyl |
| (2-41) | n-Octyl | n-Octyl | n-Butyl | n-Hexyl |
| (2-42) | n-Octyl | n-Octyl | n-Butyl | n-Octyl |

TABLE 4

| Compound | $R^{11}$ | $R^{12}$ | $R^{13}$ | $R^{4}$ |
|---|---|---|---|---|
| (2-43) | n-Octyl | n-Octyl | sec-Butyl | n-Butyl |
| (2-44) | n-Octyl | n-Octyl | n-Octyl | n-Butyl |
| (2-45) | n-Octyl | n-Octyl | n-Octyl | n-Octyl |
| (2-46) | Cyclohexyl | Cyclohexyl | n-Propyl | n-Butyl |
| (2-47) | Cyclohexyl | Cyclohexyl | n-Butyl | n-Pentyl |
| (2-48) | Cyclohexyl | n-Octyl | n-Octyl | n-Octyl |
| (2-49) | 2-Etylhexyl | 2-Etylhexyl | Methyl | n-Propyl |
| (2-50) | 2-Etylhexyl | 2-Etylhexyl | Methyl | n-Butyl |
| (2-51) | 2-Etylhexyl | 2-Etylhexyl | Methyl | n-Pentyl |
| (2-52) | 2-Etylhexyl | 2-Etylhexyl | Methyl | n-Hexyl |
| (2-53) | 2-Etylhexyl | 2-Etylhexyl | Methyl | n-Octyl |

TABLE 4-continued

| Compound | $R^{11}$ | $R^{12}$ | $R^{13}$ | $R^{4}$ |
|---|---|---|---|---|
| (2-54) | 2-Etylhexyl | 2-Etylhexyl | Ethyl | n-Propyl |
| (2-55) | 2-Etylhexyl | 2-Etylhexyl | Ethyl | n-Butyl |
| (2-56) | 2-Etylhexyl | 2-Etylhexyl | Ethyl | n-Pentyl |
| (2-57) | 2-Etylhexyl | 2-Etylhexyl | Ethyl | n-Hexyl |
| (2-58) | 2-Etylhexyl | 2-Etylhexyl | n-Propyl | n-Propyl |
| (2-59) | 2-Etylhexyl | 2-Etylhexyl | n-Propyl | n-Butyl |
| (2-60) | 2-Etylhexyl | 2-Etylhexyl | n-Propyl | n-Octyl |
| (2-61) | 2-Etylhexyl | 2-Etylhexyl | n-Butyl | n-Butyl |
| (2-62) | 2-Etylhexyl | 2-Etylhexyl | n-Butyl | n-Pentyl |
| (2-63) | 2-Etylhexyl | 2-Etylhexyl | sec-Butyl | n-Propyl |
| (2-64) | 2-Etylhexyl | 2-Etylhexyl | sec-Butyl | n-Butyl |
| (2-65) | 2-Etylhexyl | 2-Etylhexyl | n-Octyl | n-Propyl |
| (2-66) | 2-Etylhexyl | n-Octyl | n-Octyl | n-Butyl |

Tables 3 and 4 show examples of the compound expressed by formula (2). Among these (2-26), (2-27), (2-30), (2-38), (2-39), (2-40), (2-42), (2-49), (2-50), (2-51), (2-52), and (2-53) are advantageous.

(3)

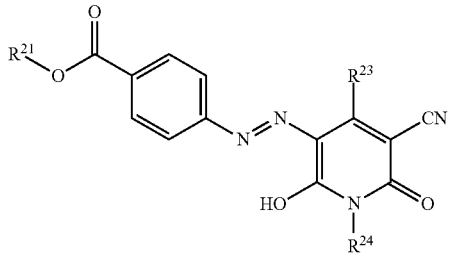

TABLE 5

| Compound | $R^{21}$ | $R^{23}$ | $R^{24}$ |
|---|---|---|---|
| (3-1) | n-Propyl | Methyl | n-Propyl |
| (3-2) | n-Propyl | Ethyl | n-Butyl |
| (3-3) | n-Propyl | n-Propyl | n-Butyl |
| (3-4) | n-Propyl | n-Butyl | n-Propyl |
| (3-5) | n-Propyl | n-Butyl | n-Butyl |
| (3-6) | n-Propyl | n-Butyl | n-Pentyl |
| (3-7) | n-Propyl | sec-Butyl | n-Pentyl |
| (3-8) | n-Propyl | n-Octyl | n-Butyl |
| (3-9) | Isopropyl | Methyl | n-Butyl |
| (3-10) | Isopropyl | Ethyl | n-Propyl |
| (3-11) | Isopropyl | n-Propyl | n-Butyl |
| (3-12) | Isopropyl | n-Butyl | n-Butyl |
| (3-13) | Isopropyl | sec-Butyl | n-Pentyl |
| (3-14) | Isopropyl | n-Octyl | n-Hexyl |
| (3-15) | n-Butyl | Methyl | n-Propyl |
| (3-16) | n-Butyl | Ethyl | n-Octyl |
| (3-17) | n-Butyl | n-Propyl | n-Butyl |
| (3-18) | n-Butyl | n-Butyl | n-Propyl |
| (3-19) | n-Butyl | n-Butyl | n-Butyl |
| (3-20) | n-Butyl | n-Butyl | n-Pentyl |
| (3-21) | n-Butyl | sec-Butyl | n-Butyl |
| (3-22) | n-Butyl | n-Octyl | n-Butyl |
| (3-23) | sec-Butyl | Methyl | n-Butyl |
| (3-24) | sec-Butyl | Ethyl | n-Pentyl |
| (3-25) | sec-Butyl | n-Butyl | n-Butyl |
| (3-26) | tert-Butyl | Methyl | n-Butyl |
| (3-27) | tert-Butyl | n-Propyl | n-Pentyl |
| (3-28) | tert-Butyl | n-Butyl | n-Butyl |
| (3-29) | n-Octyl | Methyl | n-Propyl |
| (3-30) | n-Octyl | Methyl | n-Octyl |
| (3-31) | n-Octyl | Ethyl | n-Butyl |
| (3-32) | n-Octyl | n-Propyl | n-Butyl |
| (3-33) | n-Octyl | n-Butyl | n-Propyl |
| (3-34) | n-Octyl | n-Butyl | n-Butyl |
| (3-35) | n-Octyl | sec-Butyl | n-Butyl |

TABLE 5-continued

| Compound | $R^{21}$ | $R^{23}$ | $R^{24}$ |
|---|---|---|---|
| (3-36) | n-Octyl | n-Octyl | n-Hexyl |
| (3-37) | Cyclohexyl | Methyl | n-Propyl |
| (3-38) | Cyclohexyl | Methyl | n-Hexyl |
| (3-39) | Cyclohexyl | n-Propyl | n-Butyl |
| (3-40) | Cyclohexyl | n-Butyl | n-Pentyl |

TABLE 6

| | | | |
|---|---|---|---|
| (3-41) | Cyclohexyl | n-Octyl | n-Octyl |
| (3-42) | 2-Etylhexyl | Methyl | n-Propyl |
| (3-43) | 2-Etylhexyl | Methyl | n-Butyl |
| (3-44) | 2-Etylhexyl | Methyl | n-Pentyl |
| (3-45) | 2-Etylhexyl | Methyl | n-Hexyl |
| (3-46) | 2-Etylhexyl | Methyl | n-Octyl |
| (3-47) | 2-Etylhexyl | Ethyl | n-Propyl |
| (3-48) | 2-Etylhexyl | Ethyl | n-Butyl |
| (3-49) | 2-Etylhexyl | Ethyl | n-Hexyl |
| (3-50) | 2-Etylhexyl | n-Propyl | n-Octyl |
| (3-51) | 2-Etylhexyl | n-Butyl | n-Propyl |
| (3-52) | 2-Etylhexyl | n-Butyl | n-Butyl |
| (3-53) | 2-Etylhexyl | n-Butyl | n-Hexyl |
| (3-54) | 2-Etylhexyl | n-Butyl | n-Octyl |
| (3-55) | 2-Etylhexyl | sec-Butyl | n-Propyl |
| (3-56) | 2-Etylhexyl | sec-Butyl | n-Butyl |
| (3-57) | 2-Etylhexyl | n-Octyl | n-Propyl |
| (3-58) | 2-Etylhexyl | n-Octyl | n-Butyl |

Tables 5 and 6 show examples of the compound expressed by formula (3). Among these (3-42), (3-43), (3-44), (3-45), (3-46), (3-52), and (1-54) are advantageous.

The compound expressed by any one of formulas (1) to (3) (hereinafter this compound may be referred to as the colorant compound) may be used singly or in combination with a known yellow solvent for adjusting the color of the toner, depending on the process for producing the toner.

Alternatively, the colorant compound may be combined with a yellow pigment, such as C.I. Pigment Yellow 180, 155, 150, or 74. One of these pigments may be used, or a mixture of two or more of such pigments may be used.

Binder Resin

The binder resin may be a thermoplastic resin. Examples of the thermoplastic resin include styrene-based resins that are homopolymers or copolymers of styrene compounds, such as styrene, p-chlorostyrene, and α-methylstyrene; vinyl-based resins that are homopolymers or copolymers of vinyl-containing esters, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl-based reins that are homopolymers or copolymers of vinyl nitrile compound, such as acrylonitrile and methacrylonitrile; vinyl-based resins that are homopolymers or copolymers of vinyl ethers, such as vinyl ethyl ether and vinyl isobutyl ether; vinyl-based resins that are homopolymers or copolymers of alkyl vinyl ketones, such as methyl vinyl ketone, ethyl vinyl ketone, and isopropenyl vinyl ketone; olefin-based resins that are homopolymers or copolymers of olefins, such as ethylene, propylene, butadiene, and isoprene; non-vinyl condensed polymers, such as epoxy resin, polyester resin, polyurethane resin, polyamide resin, cellulose resin, and polyether resin; and graft copolymers of any of these non-vinyl condensed polymers and a vinyl monomer. These binder resins may be used singly or in combination.

Polyester resin is synthesized from an acid and an alcohol. Hence, a polyester resin includes a portion derived from an acid and a portion derived from an alcohol.

The acid may be, for example, an aliphatic dicarboxylic acid, dicarboxylic acid having a double bond, or a dicarboxylic acid having a sulfo group. Examples of these acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid. Lower alkyl esters or acid anhydrides of these acids may be used for synthesizing the polyester resin. Aliphatic dicarboxylic acids are advantageous, and dicarboxylic acids of saturated aliphatic compounds are more advantageous.

The alcohol component of the polyester resin may be an aliphatic diol. Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

In order to enhance the mechanical strength of the toner particles and control the molecular weight of the binder resin, a crosslinking agent may be used when the binder resin is synthesized.

Examples of the crosslinking agent include bifunctional crosslinking agents, such as divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400 and #600, dipropylene glycol diacrylate, polypropylene glycol diacrylate, polyesterified diacrylate, and dimethacrylates corresponding to these diacrylates.

Trifunctional crosslinking agents may also be used, such as pentaerythritol triacrylate, trimethylolethane triacrylate, trimethylolpropane triacrylate, tetramethylolmethane tetraacrylate, oligoester acrylate, oligoester methacrylate, 2,2-bis(4-methacryloxyphenyl)propane, diallyl phthalate, triallyl cyanurate, triallyl isocyanurate, and triallyl trimellitate.

The crosslinking agent can be used with a proportion of 0.05 part to 10 parts by mass, more preferably 0.1 part to 5 parts by mass, relative to 100 parts by mass of the binder resin.

Toner particles of the toner of the present disclosure may be produced by a pulverization method, a suspension polymerization method, a suspension granulation method, an emulsion polymerization method, or an emulsion aggregation method. In the pulverization method, toner particles are produced by kneading a resin composition containing a binder resin and a colorant, and pulverizing the kneaded composition. In the suspension polymerization method, a polymerizable monomer composition containing a colorant and a polymerizable monomer is suspended in an aqueous medium to polymerize the polymerizable monomer into a binder resin. Thus, toner particles containing the binder resin are produced. In the suspension granulation method, a solution containing a colorant and a binder resin is suspended in an aqueous medium, and the suspension is granulated to form toner particles. In the emulsion aggregation method, a dispersion liquid produced by emulsifying the binder resin and a dispersion liquid of the colorant are mixed, and the mixture is subjected to aggregation and heat fusing to form toner particles.

It is advantageous that the toner particles be produced by a method performing granulation in an aqueous medium, such as the suspension polymerization method or the emulsion granulation method.

Colorant Dispersion

A colorant dispersion used in the present disclosure will now be described. The term dispersion medium mentioned herein refers to water, an organic solvent, or a mixture of water and an organic solvent.

The colorant dispersion is prepared by dispersing the compound (colorant compound) expressed by any one of formulas (1) to (3) in a dispersion medium. More specifically, the colorant dispersion can be prepared by the following process. The colorant compound expressed by any one of formulas (1) to (3), and optionally a resin, is sufficiently acclimated with a dispersion medium while being stirred. Then, a mechanical shear force is applied to the mixture with a disperser, such as ball mill, paint shaker, dissolver, attritor, sand mill, or high speed mill, so as to uniformly disperse the colorant compound, thereby producing a stable dispersion of fine particles of the compound.

The proportion of the colorant compound in the colorant dispersion is desirably in the range of 1 part to 30 parts by mass relative to 100 parts by mass of the dispersion medium. More desirably, it is in the range of 2 pats to 20 parts by mass, more preferably 3 parts to 15 parts by mass. By controlling the proportion of the colorant compound in such a range, the viscosity of the colorant dispersion can be prevented from increasing, and the colorant compound can be sufficiently dispersed. Consequently, the resulting toner can exhibit satisfactory tinting strength.

The colorant dispersion may be dispersed in water with an emulsifier. The emulsifier may be a cationic surfactant, an anionic surfactant, or a nonionic surfactant. Examples of the cationic surfactant include dodecylammonium chloride, dodecylammonium bromide, dodecyltrimethylammonium bromide, dodecylpyridinium chloride, dodecylpyridinium bromide, and hexadecyltrimethylammonium bromide. Examples of the anionic surfactant include fatty acid soaps, such as sodium stearate and sodium dodecanoate; and sodium dodecyl sulfate and sodium dodecylbenzene sulfate. Examples of the nonionic surfactant include dodecyl polyoxyethylene ether, hexadecyl polyoxyethylene ether, nonylphenyl polyoxyethylene ether, sorbitan monooleate polyoxyethylene ether, and monodecanoyl sucrose.

Exemplary organic solvents that can be used as the dispersion medium include: alcohols, such as methyl alcohol, ethyl alcohol, modified ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, and cyclohexanol; glycols, such as methyl cellosolve, ethyl cellosolve, diethylene glycol, and diethylene glycol monobutyl ether; ketones, such as acetone, methyl ethyl ketone, and methyl isobutyl ketone; esters, such as ethyl acetate, butyl acetate, ethyl propionate, and cellosolve acetate; hydrocarbons, such as hexane, octane, petroleum ether, cyclohexane, benzene, toluene, and xylene; halogenated hydrocarbons, such as carbon tetrachloride, trichloroethylene, and tetrabromoethane; ethers, such as diethyl ether, dimethyl glycol, trioxane, and tetrahydrofuran; acetals, such as methylal and diethyl acetal; organic acids, such as formic acid, acetic acid, and propionic acid; and sulfur- or nitrogen-containing organic compounds, such as nitrobenzene, dimethylamine, monoethanolamine, pyridine, dimethylsulfoxide, and dimethylformamide.

The colorant dispersion may contain a polymerizable monomer. The polymerizable monomer may be an addition-polymerizable or a condensation-polymerizable monomer. Addition-polymerizable monomers are more suitable. Examples of such a polymerizable monomer include styrene monomers, such as styrene, o-methylstyrene, m-methylstyrene, p-methylstyrene, o-ethylstyrene, m-ethylstyrene, and p-ethylstyrene; acrylate monomers, such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and amide acrylate; methacrylate monomers, such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and amide methacrylate; olefin monomers, such as ethylene, propylene, butylene, butadiene, isoprene, isobutylene, and cyclohexene; vinyl halides, such as vinyl chloride, vinylidene chloride, vinyl bromide, and vinyl iodide; vinyl esters, such as vinyl acetate, vinyl propionate, and vinyl benzoate; vinyl ethers, such as vinyl methyl ether, vinyl ethyl ether, and vinyl isobutyl ether; and vinyl ketone compounds, such as vinyl methyl ketone, vinyl hexyl ketone, and methyl isopropenyl ketone. These polymerizable monomers may be used singly or in combination. If the colorant dispersion is used for a polymerized toner, it is advantageous to use styrene or a styrene-based monomer or a mixture thereof with another polymerizable monomer. Styrene is easy to handle and is therefore advantageous.

The colorant dispersion may further contain a resin. The resin that can be used in the colorant dispersion is not particularly limited and is selected according to the use of the colorant dispersion. Examples of the resin include polystyrene resin, styrene copolymer, polyacrylic acid resin, polymethacrylic acid resin, polyacrylic ester resin, polymethacrylic ester resin, acrylic acid-based copolymer, methacrylic acid-based copolymer, polyester resin, polyvinyl ether resin, polyvinyl methyl ether resin, polyvinyl alcohol resin, and polyvinyl butyral resin. These resins may be used singly or in combination.

The proportion of the colorant containing the colorant dispersion in the toner may be in the range of 1 part to 20 parts by mass relative to 100 parts by mass of the binder resin. The colorant with such a proportion allows the toner to have a satisfactory density and can be sufficiently enclosed in the toner particles.

Constituents of Toner

The constituents of the toner of the present disclosure will now be described. The yellow toner of the present disclosure contains toner particles containing a binder resin and a colorant. By using the colorant dispersion for producing the toner, the increase in viscosity of dispersion can be suppressed. Accordingly, the handling of the production process becomes easy, and the dispersion state of the colorant is kept good. Consequently, the resulting yellow toner exhibits high tinting strength.

The toner particles may contain a wax. Examples of the wax include paraffin waxes, microcrystalline waxes, petroleum waxes and their derivatives such as petrolatum, montan waxes and their derivatives, hydrocarbon waxes produced by Fischer-Tropsch process and their derivatives, polyolefin waxes and their derivatives, such as polyethylene wax and polypropylene wax, and natural waxes and their derivatives such as carnauba wax and candelilla wax. Derivatives of these waxes include oxides, block copolymers with vinyl monomers, and graft-modified forms. Other waxes may be used. Examples thereof include alcohols such as higher aliphatic alcohols, fatty acids such as stearic acid and palmitic acid and compounds thereof, acid amide waxes, ester waxes, ketones, hydrogenated castor oil and derivatives thereof, plant waxes, and animal waxes. These and those waxes may be used singly or in combination.

The proportion of the wax may be in the range of 2.5 parts to 15 parts by mass relative to 100 parts by mass of the binder resin. Advantageously, it is in the range of 3 parts to 10 parts by mass. When the proportion of the wax is in the range of 2.5 parts to 15 parts by mass, the resulting toner enables satisfactory oilless fusing and can have a desired chargeability without excess wax at the surfaces of the particles thereof. The wax content in the toner particles may be in the range of 1 part to 25 parts by mass relative to 100 parts by mass of the toner particles, and is desirably in the range of 3 parts to 20 parts by mass. The wax with a content in such a range enables the resulting toner to have both good releasability and good developability.

The melting point of the wax is desirably in the range of 50° C. to 200° C., more preferably 55° C. to 150° C. The melting point of a material mentioned herein is the endothermic peak temperature in a differential scanning calorimetry (DSC) curve of the material measured in accordance with ASTM D3418-82. More specifically, for determining the melting point of the wax, a DSC curve in the temperature range of 30° C. to 200° C. is prepared by measuring heat flux in the second heating operation performed at a heating rate of 5° C./min under the environment of room temperature and normal humidity, using a differential scanning calorimeter (for example, DSC 822 manufactured by Mettler Toledo). The endothermic peak temperature in the DSC curve is the melting point of the material.

The toner of the present disclosure may contain a charge control agent, if necessary. A known charge control agent may be used. For controlling the toner to be negatively chargeable, the charge control agent can be selected from the following: homopolymers or copolymers including a sulfo group or a sulfonate or sulfonic acid ester group; salicylic acid derivatives and metal complexes thereof; monoazo metal compounds; acetyl acetone metal compounds; aromatic oxycarboxylic acids and metal salts, anhydrides and esters thereof; aromatic monocarboxylic or polycarboxylic acids and metal salts, anhydrides and esters thereof; phenol derivatives such as bisphenols; urea derivatives; metal-containing naphthoic acid compounds; boron compounds; quaternary ammonium salts; calixarene; and resin-based charge control agents.

For controlling the toner to be positively chargeable, the charge controlling agent can be selected from the following: nigrosine and fatty acid metal salt-modified nigrosine compounds; guanidine compounds; imidazole compounds; quaternary ammonium salts such as tributylbenzylammonium-1-hydroxy-4-naphthsulfonates and tetrabutylammonium tetrafluoroborate; onium salts similar to quaternary ammonium salts, such as phosphonium salts, and chelate pigments of onium salts; triphenylmethane dye and lake pigments thereof (prepared using a lake-forming agent, such as phosphotungstic acid, phosphomolybdic acid, phosphotungsten molybdic acid, tannic acid, lauric acid, gallic acid, ferricyanic acid, or ferrocyanide); higher fatty acid salts; diorganotin oxides, such as dibutyltin oxide, dioctyltin oxide, and dicyclohexyltin oxide; and diorganotin borates, such as dibutyltin borate, dioctyltin borate, and dicyclohexyltin borate. These and those charge control agents may be used singly or in combination.

The toner may further contain an inorganic fine powder as an external additive for enhancing fluidity. The inorganic fine powder may a fine powder of silica, titanium oxide, alumina, and complex oxide thereof. The particles of the fine powder may be surface-treated.

The weight average particle size (D4) of the toner is, for example, 4.0 μm to 9.0 μm, and the ratio (D4/D1) of the weight-average particle size to the number-average particle size (D1) is, for example, 1.35 or less. Desirably, the weight-average particle size D4 is in the range of 4.9 μm to 7.5 μm and the D4/D1 ratio is 1.30 or less. The toner having a weight-average particle size of 4.0 μm or more is stable in chargeability. Accordingly, deterioration of images, such as fogging and development streaks, caused by continuous operation (persistence of operation) for developing many printing sheets can be reduced. Also, when the weight average particle size of the toner is 9.0 μm or less, the reproducibility of half tone image portions is improved. When the D4/D1 ratio is 1.35 or less, fogging is reduced and transferability is improved. In addition, the variation of the thickness of thin lines is reduced (this property is hereinafter referred to as sharpness).

The average circularity of the toner particles measured with a flow particle image analyzer is desirably in the range of 0.930 to 0.995, more desirably 0.960 to 0.990, from the viewpoint of improving the transferability of the toner.

In the suspension polymerization method, the toner particles are produced as below.

First, a polymerizable monomer composition is prepared by mixing the materials including the colorant containing the colorant dispersion, a polymerizable monomer, a wax, and a polymerization initiator. Subsequently, the polymerizable monomer composition is dispersed in a previously prepared aqueous medium containing a dispersion stabilizer to prepare a suspension (step of granulation). Then, the polymerizable monomer in the suspension is polymerized to yield a binder resin. After the binder resin has been polymerized, the solvent is removed, if necessary. Thus, a dispersion of toner particles in an aqueous medium is obtained. The dispersion liquid is washed, if necessary. Then the toner particles are dried, sized, and treated with an external additive by appropriate methods to yield the toner.

The polymerizable monomer composition may be prepared by dispersing the colorant in a first polymerizable monomer and then mixing the dispersion with a second polymerizable monomer. More specifically, the colorant containing the colorant dispersion is sufficiently dispersed in the first polymerizable monomer, and then the resulting dispersion is mixed with the second polymerizable monomer together with other toner materials. This operation enables the colorant compound of the present disclosure to be present in a well-dispersed state in the toner particles.

The polymerization initiator can be selected from among the known polymerization initiators including azo compounds, organic peroxides, inorganic peroxides, organic metal compounds, and photopolymerization initiators. Examples of such a polymerization initiator include azo polymerization initiators, such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis(isobutyrate); organic peroxide polymerization initiators, such as benzoyl peroxide, di-tert-butyl peroxide, tert-butylperoxyisopropyl monocarbonate, tert-hexyl peroxybenzoate, and tert-butyl peroxybenzoate; inorganic peroxide polymerization initiators, such as potassium persulfate and ammonium persulfate; and redox initiators, such as hydrogen peroxide with ferrous ion, BPO-dimethyl aniline, and cerium (IV) salt-alcohol. The photopolymerization initiator may be an acetophenone-based, a benzoin ether-based, or a ketal-based initiator. These polymerization initiators may be used singly or in combination.

The proportion of the polymerization initiator used may be 0.1 part to 20 parts by mass, such as 0.1 part to 10 parts by mass, relative to 100 parts by mass of the polymerizable monomer. Although the suitable polymerization initiator is selected depending slightly on the polymerization method, one or more initiators are selected in reference to the 10-hour half-life temperature.

The dispersion stabilizer may be selected from among known inorganic and organic dispersion stabilizers. Exemplary inorganic dispersion stabilizers include calcium phosphate, magnesium phosphate, aluminum phosphate, zinc phosphate, magnesium carbonate, calcium carbonate, calcium hydroxide, magnesium hydroxide, and aluminum hydroxide, calcium metasilicate, calcium sulfate, barium sulfate, bentonite, silica, and alumina. Exemplary organic dispersion stabilizers include polyvinyl alcohol, gelatin, methyl cellulose, methyl hydroxypropyl cellulose, ethyl cellulose, carboxymethyl cellulose sodium salt, and starch. A nonionic, an anionic, or a cationic surfactant may be used. Examples of such a surfactant include sodium dodecyl sulfate, sodium tetradecyl sulfate, sodium pentadecyl sulfate, sodium octyl sulfate, sodium oleate, sodium laurate, potassium stearate, and calcium oleate.

A poorly water-soluble inorganic dispersion stabilizer soluble in acid is advantageous as the dispersion stabilizer used in the present disclosure. If a poorly water-soluble inorganic dispersion stabilizer is used for preparing the aqueous medium, the proportion of the dispersion stabilizer is desirably in the range of 0.2 part to 2.0 parts by mass to 100 parts by mass of the polymerizable monomer from the viewpoint of stabilizing the droplets of the polymerizable monomer composition in the aqueous medium. Water may be used as the aqueous medium with a proportion in the range of 300 parts to 3000 parts by mass to 100 parts by mass of the polymerizable monomer.

For an aqueous medium containing a poorly water-soluble inorganic dispersion stabilizer, fine particles of the dispersion stabilizer having a uniform particle size are desirably used. Such particles may be formed by sufficiently dispersing the dispersion stabilizer in water with high-speed agitation. For example, if calcium phosphate is used as the dispersion stabilizer, a sodium phosphate aqueous solution and a calcium chloride aqueous solution are mixed with high-speed agitation for forming fine particles of calcium phosphate. Thus produced calcium phosphate can be used as a suitable dispersion stabilizer.

The toner particles of the toner of the present disclosure may be produced in the suspension granulation method, and such particles are also good.

In the suspension granulation method, the toner particles are produced as below. First, a solvent composition is prepared by mixing the materials including the colorant containing the colorant dispersion, a binder resin, and a wax in a solvent. Subsequently, the solvent composition is dispersed in an aqueous medium to prepare a suspension of particles of the solvent composition. Then, the solvent is removed from the resulting suspension by heating or reducing pressure to yield toner particles.

The solvent composition may be prepared by dispersing the colorant in a first solvent and then mixing the dispersion with a second solvent. More specifically, the colorant containing the colorant dispersion is sufficiently dispersed in the first solvent, and then the resulting dispersion is mixed with the second solvent together with other toner materials. This operation enables the colorant compound of the present disclosure to be present in a well-dispersed state in the toner particles.

The solvent used for suspension granulation may be selected from among hydrocarbons, such as toluene, xylene, and hexane; halogen-containing hydrocarbons, such as methylene chloride, chloroform, dichloroethane, trichloroethane, and carbon tetrachloride; alcohols, such as methanol, ethanol, butanol, and isopropyl alcohol; polyhydric alcohols, such as ethylene glycol, propylene glycol, diethylene glycol, and triethylene glycol; cellosolves, such as methyl cellosolve and ethyl cellosolve; ketones, such as acetone, methyl ethyl ketone, and methyl isobutyl ketone; ethers, such as benzyl ethyl ether, benzyl isopropyl ether, and tetrahydrofuran; and esters, such as methyl acetate, ethyl acetate, and butyl acetate. These solvents may be used singly or in combination. From the viewpoint of easily removing the solvent from the suspension, solvents having a low boiling point and capable of sufficiently dissolving the binder resin are advantageous.

The proportion of the solvent used is desirably in the range of 50 parts to 5000 parts by mass, such as 120 parts to 1000 parts by mass, relative to 100 parts by mass of the binder resin.

The aqueous medium used in the suspension granulation method may contain a dispersion stabilizer. The dispersion stabilizer may be selected from among known inorganic and organic dispersion stabilizers, and the dispersion stabilizers cited for the above-described suspension polymerization method can be used.

The proportion of the dispersion stabilizer used is desirably in the range of 0.01 part to 20 parts by mass relative to 100 parts by mass of the binder resin from the viewpoint of stabilizing the droplets of the solvent composition in the aqueous medium.

The weight-average particle size D4 and the number-average particle size D1 of the toner are controlled depending on the production method of the toner particles. When the toner particles are produced by the suspension polymerization method, for example, the particle size of the toner can be controlled by controlling the concentration of the dispersant used for preparing the aqueous medium, the agitation or stirring speed for reaction, or the reaction time.

The toner may be produced in a pulverization method using a mixer, a heat kneader, a classifier, or any other known machine. First, a resin composition containing a binder resin and a colorant is sufficiently agitated with a mixer, such as a Henschel mixer or a ball mill. Then, the composition is melted with a heat kneader such as a roll, a kneader, or an extruder. Furthermore, a wax and a magnetic material are dispersed in the resin composition, in which the constituents are dissolved in each other, by being kneaded. After cooling and solidification, the kneaded mixture is pulverized and sized to yield toner particles.

Examples of the binding resin used in the toner produced by the pulverization method include vinyl resin, polyester resin, epoxy resin, polyurethane resin, polyvinyl butyral resin, terpene resin, phenol resin, aliphatic or alicyclic hydrocarbon-based resin, aromatic petroleum-based resin, rosin, and modified rosin. Vinyl resin and polyester resin are advantageous in view of chargeability and fixability. In particular, polyester resin is highly effective in increasing chargeability and fixability and is thus more advantageous. Binder resins may be used singly or in combination. If two or more binder resins are used in combination, it is desirable to use resins having different molecular weights to control the viscoelasticity of the toner.

The binder resin desirably has a glass transition temperature in the range of 45° C. to 80° C., more preferably 55° C. to 70° C. The number average molecular weight (Mn) of the binder resin is desirably in the range of 2,500 to 50,000, and the weight average molecular weight (Mw) thereof is desirably in the range of 10,000 to 1,000,000.

If a polyester resin is used as the binder resin, the alcohol component/acid component proportion in the polyester resin is in the range of 45/55 to 55/45 on a mole basis. As the number of the terminal groups of the polyester resin is increased, the chargeability of the toner becomes more dependent on environment. Accordingly, the acid value of the polyester resin is desirably 90 mg KOH/g or less, and more desirably 50 mg KOH/g or less. Also, the hydroxy value of the polyester resin is desirably 50 mg KOH/g or less, and more desirably 30 mg KOH/g or less. The polyester resin desirably has a glass transition temperature in the range of 50° C. to 75° C., more preferably 55° C. to 65° C. The number average molecular weight (Mn) of the polyester resin is desirably in the range of 1,500 to 50,000, and more desirably in the range of 2,000 to 20,000. The weight average molecular weight (Mw) of the polyester resin is desirably in the range of 6,000 to 100,000, and more desirably in the range of 10,000 to 90,000.

In the emulsion aggregation method, a dispersion liquid produced by emulsifying the binder resin for dispersion and a dispersion liquid of the colorant are mixed, and the mixture is subjected to aggregation and heat fusing to form toner particles. This method will be further described in detail.

First, dispersion liquids (resin particle dispersion liquid and colorant particle dispersion liquid) are prepared. To these dispersion liquids, a wax dispersion liquid and other toner materials may be added as required.

The dispersion liquids are mixed, and the mixture is subjected to aggregation to form aggregated particles (aggregation step). The aggregated particles are heated to be fused (fusing step). The fused product is washed and dried to yield toner particles.

Each dispersion liquid may contain a dispersant, such as a surfactant. More specifically, the colorant particle dispersion liquid may be prepared by dispersing the colorant and a surfactant in an aqueous medium. For dispersing the colorant particles, a dispersing machine is used, and examples thereof include, but are not limited to, rotary shear homogenizers, media dispersing devices such as a ball mill, a sand mill, and an attritor, and high-pressure counter collision dispersing machines.

The resin particle dispersion liquid and the wax dispersion liquid are prepared by dispersing the binder resin or a wax in an aqueous medium. The resin particles in the resin particle dispersion liquid may have an average particle size of 0.005 μm to 1.0 μm, such as 0.01 μm to 0.4 μm on a volume basis.

The average particle size of the resin particles can be measured by dynamic light scattering (DLS), laser scattering, centrifugal sedimentation, field-flow fractionation, electrical detection, or the like. The average particle size mentioned herein refers to D50 or median diameter that is the value of the particle diameter at 50% in the cumulative distribution on a volume basis obtained by measuring a sample having a solids content of 0.01% by mass at 20° C. by a DLS/laser Doppler method.

The surfactant may be a water-soluble polymer or an inorganic compound, and may be an ionic or nonionic surfactant. In view of dispersibility, highly dispersible ionic, particularly anionic, surfactants are suitable. The molecular weight of the surfactant is desirably in the range of 100 to 10,000, such as 200 to 5,000.

Examples of the surfactant include water-soluble polymers, such as polyvinyl alcohol, methyl cellulose, carboxymethyl cellulose, and sodium polyacrylate; anionic surfactants, such as sodium dodecylbenzenesulfonate, sodium octadecyl sulfate, sodium oleate, sodium laurate, and potassium stearate; cationic surfactants, such as laurylamine acetate and lauryl trimethyl ammonium chloride; amphoteric surfactants, such as lauryldimethylamine oxide; nonionic surfactants, such as polyoxyethylene alkyl ether, polyoxyethylene alkyl phenyl ether, and polyoxyethylene alkyl amine; and inorganic compounds, such as tricalcium phosphate, aluminum hydroxide, calcium sulfate, calcium carbonate, and barium carbonate. These surfactants may be used singly or in combination.

For preparing the colorant particle dispersion liquid, the colorant and the surfactant are dispersed together in an aqueous medium. First, dispersion liquids of each colorant compound expressed by any one of formulas (1) to (3) may be prepared. Alternatively, a mixture of two or some of the colorant compounds expressed by formulas (1) to (3) may be dispersed. For dispersing the colorant particles, a dispersing machine is used, and examples thereof include, but are not limited to, rotary shear homogenizers, media dispersing devices such as a ball mill, a sand mill, and an attritor, and high-pressure counter collision dispersing machines.

The proportion of the surfactant used is in the range of 0.01 part to 10 parts by mass, advantageously 0.1 part to 5 parts by mass, relative to 100 parts by mass of the colorant. From the viewpoint of easily removing the surfactant from the toner particles, the proportion of the surfactant is desirably in the range of 0.5 part to 3 parts by mass.

For forming aggregated particles, for example, a pH adjuster, a flocculant, a stabilizer, and the like are added to and mixed with the colorant particle dispersion liquid, and a temperature, a mechanical force (agitation), or the like is applied to a mixture of the dispersion liquids. The method is however not limited to this.

The pH adjuster can be selected from among alkalis, such as ammonia and sodium hydroxide, and acids, such as nitric acid and citric acid.

The flocculant may be selected from among inorganic metal salts, such as sodium chloride, magnesium carbonate, magnesium chloride, magnesium nitrate, magnesium sulfate, calcium chloride, and aluminum sulfate, and divalent or higher valent metal complexes.

The stabilizer may be selected from among the above-cited surfactants.

The average particle size of the aggregated particles formed in this operation can be controlled to the same level of the average particle size of the intended toner particles that will be produced. This control can be easily made by, for example, appropriately setting or varying the temperature at which additives such as flocculant is added and mixed. A pH adjuster or any one of the above-cited surfactants may also be added, if necessary, in order to prevent the toner particles from fusing with each other.

The aggregated particles are heated to fuse to form toner particles. In this operation, the heating temperature is set in the range from the glass transition temperature (Tg) of the resin in the aggregated particles to the decomposition temperature of the resin. For example, after aggregation is stopped by adding a surfactant or adjusting the pH while agitation or stirring is continued under the same conditions as in the aggregation step, the aggregated particles are fused with one another by being heated to a temperature higher than or equal to the glass transition temperature of the resin. In this operation, the heating is performed for a period of time for which the aggregated particles can be sufficiently fused. More specifically, it is about 10 minutes to 10 hours. In addition, an adsorption step may be performed for forming a core-shell structure of the particles before or after the fusing step. This adsorption step is formed by adding a dispersion liquid of fine particles so as to adsorb the fine particles to the aggregated particles.

The fused particles are washed, filtered, and dried, each under appropriate conditions, and thus toner particles are obtained. In this operation, it is advantageous to fully wash the toner particles from the viewpoint of ensuring chargeability and reliability sufficient to function as a toner. Washing is performed by, for example, filtering the suspension containing the toner particles, stirring the collected particles in distilled water for rinsing, and filtering the rinsed particles again. From the viewpoint of the chargeability of the toner, the washing operation is repeated until the electric conductivity of the filtrate is reduced to 150 μS/cm or less.

Furthermore, an external additive, such as an inorganic powder, may be applied to the surfaces of the resulting toner particles.

The drying of the toner particles can be performed by conventional vibration flow drying, spray drying, freeze drying, flash jetting, or any other known method. The water content in the dried toner particles is desirably 1.5% by mass or less, more desirably 1.0% by mass or less.

The toner of the present disclosure may be a magnetic toner or a nonmagnetic toner. If the toner is used as a magnetic toner, the toner particles may contain a magnetic material. Examples of the magnetic material include iron oxides, such as magnetite, maghemite, and ferrite, iron oxides containing another metal oxide, metals, such as Fe, Co, and Ni, and alloys or mixtures of these metals and other metals such as Al, Co, Cu, Pb, Mg, Ni, Sn, Zn, Sb, Be, Bi, Cd, Ca, Mn, Se, Ti, W, and V.

A method for preparing a liquid developer will now be described. The liquid developer may be prepared by dispersing or dissolving a coloring resin powder containing the colorant, and optionally additives such as a charge control agent and a wax, in an electrically insulating carrier liquid. Alternatively, the liquid developer may be prepared by a two-step process in such a manner that a previously prepared concentrated toner is diluted with an electrically insulating carrier liquid.

The coloring resin powder may be used in combination with one or more additional known colorant such as pigments and dyes. The wax and the additional colorant are the same as in the above description.

The charge control agent used in the liquid developer may be selected from those used in liquid developers for electrostatic development without particular limitation, and examples of such a charge control agent include cobalt naphthenate, copper naphthenate, copper oleate, cobalt oleate, zirconium octylate, cobalt octylate, sodium dodecylbenzenesulfonate, calcium dodecylbenzenesulfonate, soybean lecithin, and aluminum octoate.

The electrically insulating carrier liquid may be, but is not limited to, an organic solvent having a high electric resistance of $10^9$ Ω·cm or more and a low dielectric constant of 3 or less. Examples of the electrically insulating carrier liquid include aliphatic hydrocarbons, such as hexane, pentane, octane, nonane, decane, undecane, and dodecane; and commercially available solvents having a boiling point in the range of 68° C. to 250° C., such as ISOPAR series H, G, K, L, and M (each produced by Exxon Mobil) and Linealene Dimers A-20 and A-20H (each produced by Idemitsu Kosan). These carrier liquids may be used singly or in combination.

EXAMPLES

The subject matter of the present disclosure will be further described in detail with reference to the following Examples, but is not limited to the disclosed Examples. In the following description, "part(s)" and "%" are on a mass basis unless otherwise specified. The reaction products were identified by matrix-assisted laser desorption/ionization mass spectrometry (MALDI MS with an autoflex analyzer manufactured by Bruker Daltonics. Ion detection in the MALDI MS analysis is performed in a negative mode.

Synthesis Example 1: Production of Compound (2-39)

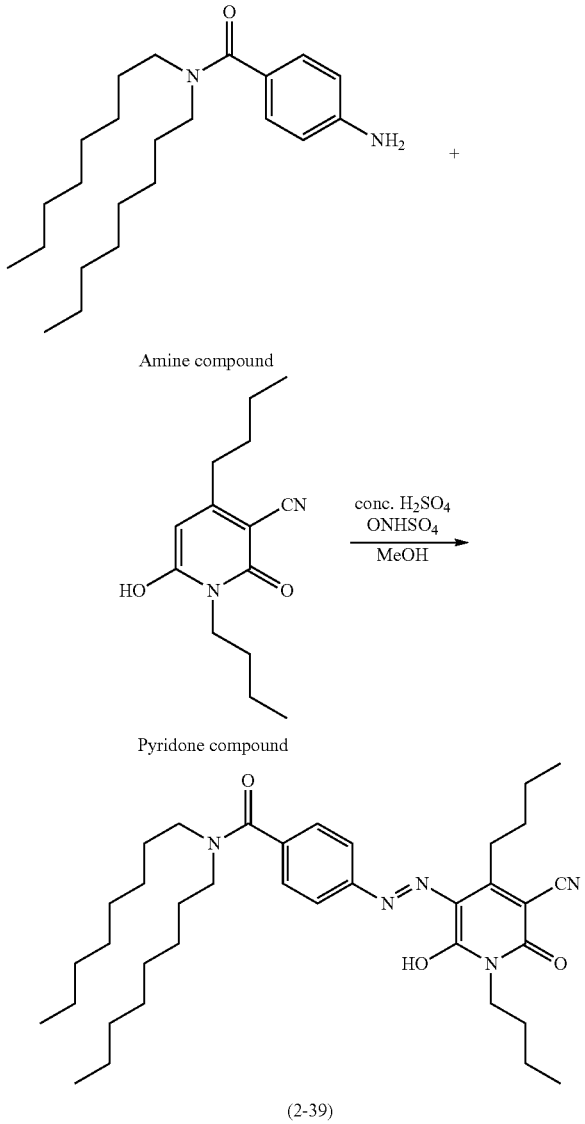

(2-39)

After 20 mL of a solution of 0.721 g of the amine compound in methanol (MeOH) was cooled to 5° C., 2 mL of concentrated sulfuric acid and 1.4 mL of 40% nitrosylsulfuric acid were added to the solution (diazotization liquid A). Similarly, 20 mL of another solution of 0.496 g of the pyridone compound in methanol (MeOH) was cooled to 5° C. To this solution the diazotization liquid A was gradually added so slowly as the temperature of the solution was kept at 5° C. or less, and the solution was stirred at a temperature of 0° C. to 5° C. for 20 minutes. After the completion of the reaction, a sodium carbonate aqueous solution was added to control the pH to 6, and the reaction product was extracted with chloroform. Then, the solvent was removed from the product, and the resulting solid was purified by column chromatography (eluent: heptane/ethyl acetate). The purified product was recrystallized in a heptane solution to yield 0.8 g of compound (2-39).

Identification Results of Compound (2-39)

MALDI MS analysis: m/z=618.612 $(M-H)^-$

Synthesis Examples 2 to 34

Compounds (1-5), (1-15), (1-26), (1-30), (1-34), (1-38), (1-39), (1-41), (1-47), (1-50), (2-3), (2-8), (2-17), (2-26), (2-27), (2-30), (2-38), (2-40), (2-42), (2-49), (2-50), (2-51), (2-52), (2-53), (3-5), (3-19), (3-42), (3-43), (3-44), (3-45), (3-46), (3-52), and (3-54) were synthesized and identified by MALDI MS in the same manner as in Synthesis Example 1.

Yellow toners according to the present disclosure and yellow toners for comparison (hereinafter referred to as comparative yellow toners) were prepared in the following procedure.

Example 1

A mixture of 5 parts of compound (1-26) and 120 parts of styrene were dispersed in each other with an attritor (manufactured by Nippon Coke & Engineering) to yield colorant dispersion (1-26).

Into a 2 L four-neck flask equipped with a high-speed agitator T.K. Homomixer (manufactured by PRIMIX) was added 710 parts of ion exchanged water and 450 pats of 0.1 mol/L trisodium phosphate aqueous solution, and the mixture was heated to 60° C. while being agitated at a rotational speed of 12000 rpm. To this mixture was gradually added 68 parts by mass of 1.0 mol/L calcium chloride aqueous solution to prepare an aqueous dispersion medium containing a small amount of poorly water-soluble dispersion stabilizer calcium chloride.

The mixture of the following materials was heated to 60° C. and was agitated with at T.K. Homomixer at 5000 rpm for dissolving or dispersing the materials.

Colorant dispersion (1-26): 133.2 parts

Styrene (monomer): 46.0 parts n-Butyl acrylate (monomer): 34.0 parts

Aluminum salicylate: 2.0 parts (Bontron E-88 produced by Orient Chemical Industries)

Polar resin: 10.0 parts polycondensate of propylene oxide-modified bisphenol A and isophthalic acid, Tg=65° C., Mw=10000, Mn=6000)

Ester wax: 25.0 parts (DSC-measured maximum endothermic peak temperature=70° C., Mn=704)

Divinylbenzene (monomer): 0.10 parts

In this mixture was dissolved 10 parts of polymerization initiator 2,2'-azobis(2,4-dimethylvaleronitrile). Thus, a polymerizable monomer composition was prepared. The polymerizable monomer composition was added to the aqueous disperse medium and granulated at a constant rotational speed of 12000 rpm for 15 minutes. Then, the high-speed agitator was replaced with a propeller stirring blade, and the polymerization was continued at 60° C. for 5 hours and was further continued at 80° C. for 3 hours. After the completion of polymerization, the unreacted monomers were evaporated at 80° C. under reduced pressure, and the sample was cooled to 30° C. to yield a dispersion liquid of polymer fine particles.

Subsequently, the dispersion of the polymer fine particles was placed in a cleaning vessel, and the pH of the dispersion was adjusted to 1.5 with stirring by adding dilute hydrochloric acid. Then, the dispersion was further stirred for 1 hour. The dispersion was filtered for liquid-solid separation, and thus polymer fine particles were obtained. Dispersion and solid-liquid separation of the polymer fine powder were repeated until compounds of phosphate and calcium including calcium phosphate were sufficiently removed. Subsequently, the polymer fine particles finally subjected to solid-liquid separation were sufficiently dried with a dryer to yield yellow toner particles (toner particles before adding an external additive).

To 100 parts of the resulting yellow toner particles, the following materials were added:

1.00 part of hydrophobic silica fine powder surface-treated with hexamethyldisilazane (number average primary particle size: 7 nm); and 0.15 part of rutile-type titanium oxide fine powder (number average primary particle size: 45 nm) and 0.50 part of rutile-type titanium oxide fine powder (number average primary particle size: 200 nm).

The mixture was agitated in a dry process for 5 minutes with a Henschel mixer (manufactured by Nippon Coke & Engineering) to yield yellow toner (1) according to the present disclosure.

Examples 2 to 32

Yellow toners (2) to (32) were produced in the same manner as in Example 1, except that compound (1-26) was replaced with the compound shown in Tables 7 and 8.

Comparative Examples 1 to 4

Comparative yellow toners (comp-1) to (comp-4) were produced in the same manner as in Example 1, except that compound (1-26) was replaced with comparative compounds (C-1) to (C-4), respectively. Comparative compounds (1) to (4) are shown below.

(C-1)

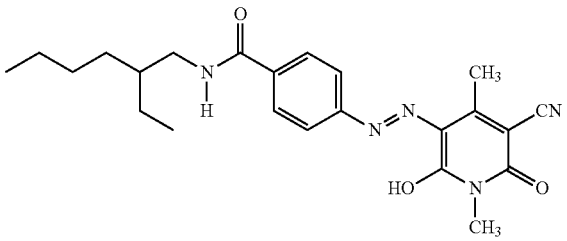

-continued (C-2)

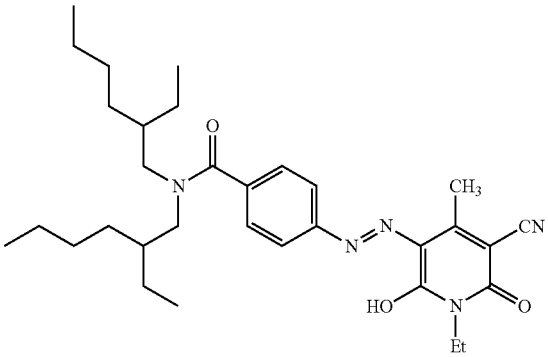

(C-3)

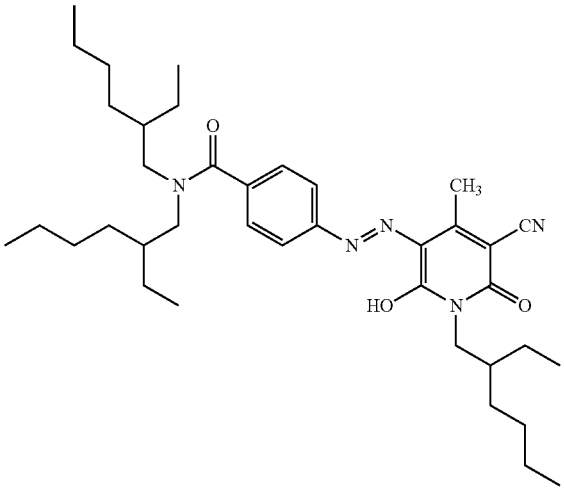

(C-4)

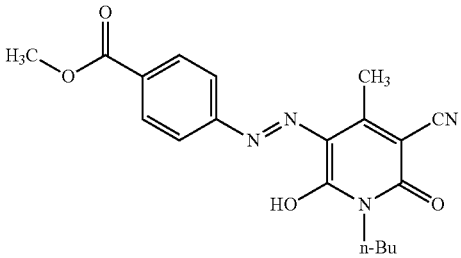

Example 33

A mixture was prepared by mixing 82.6 parts of styrene, 9.2 parts of n-butyl acrylate, 1.3 parts of acrylic acid, 0.4 part of hexanediol acrylate, and 3.2 parts of n-laurylmercaptan. To this solution, a solution made up of 1.5 parts of Neogen RK (produced by Dai-ichi Kogyo Seiyaku) and 150 parts of ion exchanged water was added for dispersing the solution. Then, a solution made up of 0.15 part of potassium persulfate and 10 parts of ion exchanged water was further added to the resulting dispersion over a period of 10 minutes with stirring. The reaction system was purged with nitrogen, and emulsion polymerization was performed at 70° C. for 6 hours. After the completion of the polymerization, the reaction liquid was cooled to room temperature, and to which ion exchanged water was added to yield resin particle dispersion liquid containing resin particles having a median diameter of 0.2 μm on a volume basis with a solids content of 12.5% by mass.

In 385 parts of ion exchanged water were mixed 100 parts of ester wax (DSC-measured maximum endothermic peak temperature=70° C., Mn=704) and 15 parts of Neogen RK. The mixture was agitated with a wet jet mill JN100 (manufactured by Jokoh) for about 1 hour to yield a wax dispersion liquid. The wax particle content in the wax dispersion liquid was 20% by mass.

In 885 parts of ion exchanged water were mixed 100 parts of compound (3-52) and 15 parts of Neogen RK. The mixture was agitated with a wet jet mill JN100 (manufactured by Jokoh) for about 1 hour to yield a dispersion liquid of compound (3-52). The colorant particles in this dispersion liquid had a median diameter of 0.2 μm on a volume basis, and the concentration of compound (3-52) in the dispersion liquid was 10% by mass.

With a homogenizer ULTRA-TURRAX T50 (manufactured by IKA) were dispersed 160 parts of resin particle dispersion liquid, 10 parts of wax dispersion liquid, 10 parts of compound (3-52) dispersion liquid, and 0.2 part of magnesium sulfate, and the mixture was heated to 65° C. while being agitated. After being agitated at 65° C. for 1 hour, the mixture was observed under an optical microscope. It was thus confirmed that aggregated particles having an average particle size of about 6.0 μm were formed. After 2.2 parts of Neogen RK (produced by Dai-ichi Kogyo Seiyaku) was added, the sample was heated to 80° C. and agitated for 120 minutes to yield fused toner particles. After being cooled, the resulting particles were filtered, and the solid separated out by filtration was stirred in 720 parts of ion exchanged water for washing for 60 minutes. The liquid containing toner particles was filtered. This operation was repeated until the electric conductivity of the filtrate was reduced to 150 μS/cm or less. Then, the toner particles were dried in a vacuum dryer to yield yellow toner particles.

With 100 parts of the resulting yellow toner particles, 1.8 parts of hydrophobized silica fine powder having a specific surface area (measured by the BET method) of 200 $m^2/g$ was mixed in a dry process with a Henschel mixer (manufactured by Nippon Coke & Engineering). Thus yellow toner (33) was produced.

Example 34

With a Henschel mixer FM-75J (manufactured by Nippon Coke & Engineering) were sufficiently mixed together 100 parts of a binder resin (polyester resin, Tg: 55° C., acid value: 20 mg KOH/g, hydroxy value: 16 mg KOH/g, molecular weight: Mp 4500, Mn 2300, Mw 38000), 5 parts of compound (3-54), 0.5 part of aluminum 1,4-di-t-butylsalicylate, and 5 parts of paraffin wax (maximum endothermic peak temperature 78° C.). The mixture was kneaded in a twin screw kneader PCM-45 (manufactured by Ikegai) set to a temperature of 130° C. at a feed rate of 60 kg/h (temperature of the mixture during extrusion was about 150° C.). After being cooled, the resulting mixture was crushed with a hammer mill, and further pulverized to a much smaller particle size with a mechanical pulverizer (T-250, manufactured by Turbo Kogyo) at a feed rate of 20 kg/h. The finely pulverized toner was sized with a multi-classification classifier using the Coanda effect, and thus yellow toner particles were produced.

With 100 parts of the resulting yellow toner particles, 1.8 parts of hydrophobized silica fine powder having a specific surface area (measured by the BET method) of 200 $m^2/g$ was mixed in a dry process with a Henschel mixer (manufactured by Nippon Coke & Engineering). Thus yellow toner (34) was produced.

Example 35

Yellow toner (35) was produced in the same manner as in Example 1 except that colorant dispersion (1-26) containing 5 parts of compound (1-26) was replaced with colorant dispersion (2-39+PY-155) prepared by agitating the mixture of 2.5 parts of C.I. Pigment Yellow 155 ("Toner Yellow 3GP" produced by Clariant) and 2.5 parts of compound (2-39) with a paint shaker.

(1) Evaluation of Blocking Resistance Property

Into a sample container 1 g of yellow toner was placed. The sample was allowed to stand under the conditions of a temperature of 50° C. and a humidity of 60% for 3 days with the lid removed, and was then visually observed for evaluation.

Each sample toner was rated according to the following criteria. When the sample toner had not formed aggregate or a block, it was judged that the blocking resistance property of the sample toner was good.

A: dry and powdery, no aggregate (good blocking resistance property)

B: aggregated (poor blocking resistance property)

(2) Evaluation of Environmental Stability of Chargeability

The changes in mass of each yellow toner sample were measured in a steam adsorption-desorption measurement apparatus Q5000SA (manufactured by TA Instrument) under the conditions of 40° C. in temperature and 95% in humidity for 3 hours.

The rating criteria are as follows. When the moisture absorption (variation in mass) was 2.5% or less, it was judged that the sample toner had good chargeability without leakage at a temperature of 40° C. and a humidity of 95%.

A: 2.5% less (good chargeability)

B: larger than 2.5% (poor chargeability)

For storage stability, the sample toners rated as A in both the blocking resistance property and the environmental stability of chargeability were rated as A; the sample toners rated as B in either the blocking resistance property or the environmental stability of chargeability were rated as B; and the sample toners rated as B in both the blocking resistance property and the environmental stability of chargeability were rated as C. The results of revaluations are shown in Table 8.

TABLE 7

Storage Stability Evaluation Results

| | Compound | Blocking resistance property | Environmental stability of chargeability | Storage stability |
|---|---|---|---|---|
| Example 1 | Compound (1-26) | A | A | A |
| Comparative Example 1 | Comparative Compound (C-1) | B | B | C |
| Example 2 | Compound (2-49) | A | A | A |
| Comparative Example 2 | Comparative Compound (C-2) | A | B | B |
| Example 3 | Compound (2-50) | A | A | A |
| Comparative Example 3 | Comparative Compound (C-3) | B | A | B |
| Example 4 | Compound (3-43) | A | A | A |
| Comparative Example 4 | Comparative Compound (C-4) | B | B | C |

Table 7 shows that toners using a comparative compound having alkyl groups having carbon numbers outside the range specified in the present disclosure exhibited poor storage stability whereas the toners using a compound having alkyl groups having carbon numbers in the range specified in the disclosure exhibited good storage stability.

(3) Evaluation of Image Samples Formed with Yellow Toner

Image samples were prepared using the above toner samples, and the image properties of the image samples were compared for evaluation. For comparing image properties, an image forming apparatus (hereinafter referred to as LBP) modified from LBP-5300 (manufactured by Canon) was used. More specifically, LBP-5300 was modified by replacing the developer blade in the process cartridge (hereinafter referred to as CRG) with an 8 μm-thick SUS blade. Furthermore, the printer was modified so that a developing bias of −200 V, which was originally intended to be applied to the developing roller that is the toner bearing member, was able to be applied to the blade. For evaluation, CRGs charged with each yellow toner were prepared for each test. Each CRG charged with a toner was set to the LBP for evaluation.

For image samples formed with each toner, the color parameters (L*, a*, and b*) in the CIE L*a*b* color system were measured with a reflection densitometer SpectroLino (manufactured by Gretag Macbeth).

Evaluation of Toner Light Fastness

Each of the image samples formed for measuring color parameters was exposed to an environment of an illuminance of 340 nm at 0.39 W/m$^2$ and at a temperature of 40° C. and a relative humidity of 60% for 40 hours in a xenon test apparatus Atlas Ci 4000 (manufactured by Suga Test Instruments). The reflected density of the printed image was measured before and after the exposure test. The color difference ΔE was defined as expressed by the following equation using initial color parameters $a_0$*, $b_0$*, and $L_0$* and color parameters a*, b*, and L* after exposure: The results are shown in Table 8. In Table 8, PY-155 represents C.I. Pigment Yellow 155.

$$\Delta E=\sqrt{(a^*-a_0^*)^2+(b^*-b_0^*)^2+(L^*-L_0^*)^2}$$

The rating criteria were as follows.

A: ΔE<5.00 (excellent light fastness)

B: 5.00≤ΔE<10.00 (good light fastness)

TABLE 8

Light Fastness Test Results

| | Exemplified Compound | Process | Storage stability | Light fastness |
|---|---|---|---|---|
| Example 1 | (1-26) | Suspension polymerization | A | A |
| Example 2 | (2-49) | Suspension polymerization | A | A |
| Example 3 | (2-50) | Suspension polymerization | A | A |
| Example 4 | (3-43) | Suspension polymerization | A | A |
| Example 5 | (2-39) | Suspension polymerization | A | A |
| Example 6 | (1-5) | Suspension polymerization | A | B |
| Example 7 | (1-15) | Suspension polymerization | A | B |
| Example 8 | (1-30) | Suspension polymerization | A | A |
| Example 9 | (1-34) | Suspension polymerization | A | B |
| Example 10 | (1-38) | Suspension polymerization | A | A |
| Example 11 | (1-39) | Suspension polymerization | A | A |
| Example 12 | (1-41) | Suspension polymerization | A | A |
| Example 13 | (1-47) | Suspension polymerization | A | A |
| Example 14 | (1-50) | Suspension polymerization | A | A |
| Example 15 | (2-3) | Suspension polymerization | A | B |
| Example 16 | (2-8) | Suspension polymerization | A | B |
| Example 17 | (2-17) | Suspension polymerization | A | B |
| Example 18 | (2-26) | Suspension polymerization | A | A |
| Example 19 | (2-27) | Suspension polymerization | A | A |
| Example 20 | (2-30) | Suspension polymerization | A | A |
| Example 21 | (2-38) | Suspension polymerization | A | A |
| Example 22 | (2-40) | Suspension polymerization | A | A |
| Example 23 | (2-42) | Suspension polymerization | A | A |
| Example 24 | (2-51) | Suspension polymerization | A | A |
| Example 25 | (2-52) | Suspension polymerization | A | A |
| Example 26 | (2-53) | Suspension polymerization | A | A |
| Example 27 | (3-5) | Suspension polymerization | A | B |
| Example 28 | (3-19) | Suspension polymerization | A | B |
| Example 29 | (3-42) | Suspension polymerization | A | A |

TABLE 8-continued

| Light Fastness Test Results | | | | |
|---|---|---|---|---|
| | Exemplified Compound | Process | Storage stability | Light fast-ness |
| Example 30 | (3-44) | Suspension polymerization | A | A |
| Example 31 | (3-45) | Suspension polymerization | A | A |
| Example 32 | (3-46) | Suspension polymerization | A | A |
| Example 33 | (3-52) | Emulsion polymerization | A | A |
| Example 34 | (3-54) | Pulverization | A | A |
| Example 35 | (2-39) + PY-155 | Suspension polymerization | A | A |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-107873, filed May 27, 2015, which is hereby incorporated by reference herein in its entirety.

What is claimed is:

1. A yellow toner comprising a toner particle containing:

a binder resin; and a colorant containing at least one compound selected from the group consisting of a compound expressed by the following formula (1), a compound expressed by the following formula (2), and a compound expressed by the following formula (3):

(1)

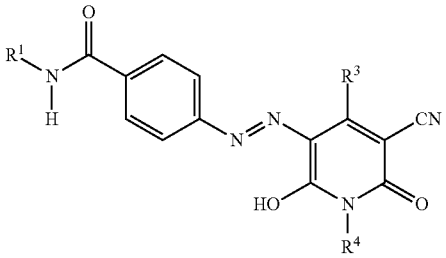

(2)

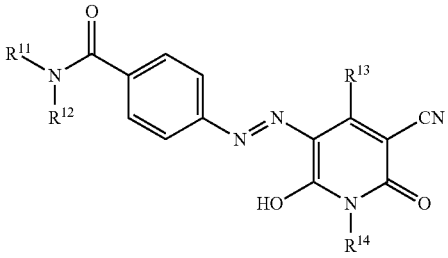

(3)

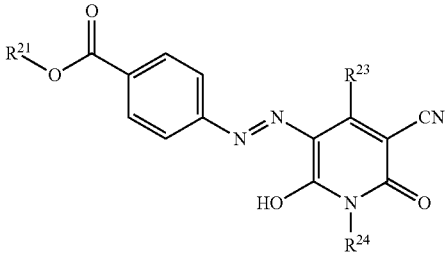

wherein in formulas (1) to (3), $R^1$, $R^{11}$, $R^{12}$, and $R^{21}$ each represent an alkyl group having a carbon number of 3 or more, $R^3$, $R^{13}$, and $R^{23}$ each represent an alkyl group, and $R^4$, $R^{14}$, and $R^{24}$ each represent a linear alkyl group having a carbon number of 3 or more, and wherein the colorant further contains a pigment selected from the group consisting of C.I. Pigment Yellows 180, 155, 150, and 74.

2. The yellow toner according to claim 1, wherein $R^1$, $R^{11}$, $R^{12}$, and $R^{21}$ are each an alkyl group having a carbon number in the range of 3 to 8.

3. The yellow toner according to claim 1, wherein $R^4$, $R^{14}$, and $R^{24}$ are each a linear alkyl group having a carbon number in the range of 3 to 8.

4. The yellow toner according to claim 1, wherein $R^1$, $R^{11}$, $R^{12}$, and $R^{21}$ are each an n-octyl group or an ethylhexyl group.

5. The yellow toner according to claim 1, wherein $R^3$, $R^{13}$, and $R^{23}$ are each an alkyl group having a carbon number in the range of 1 to 8.

6. The yellow toner according to claim 1, wherein the compound expressed by formula (1), the compound expressed by formula (2), and the compounds expressed by formula (3) are any one of a compound expressed by the following formulas (1-26), (1-30), (1-38), (1-39), (1-41), (1-47), (1-50), (2-26), (2-27), (2-30), (2-38), (2-39), (2-40), (2-42), (2-49), (2-50), (2-51), (2-52), (2-53), (3-42), (3-43), (3-44), (3-45), (3-46), (3-52), and (3-54):

(1-26)

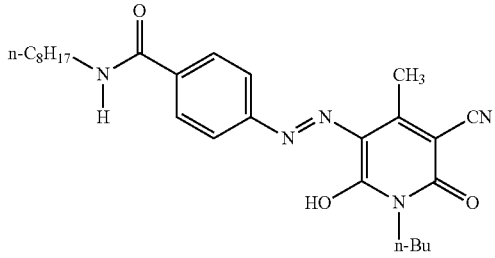

(1-30)

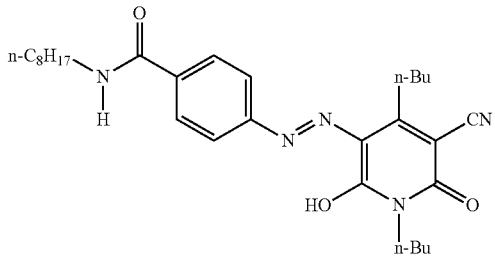

(1-38)

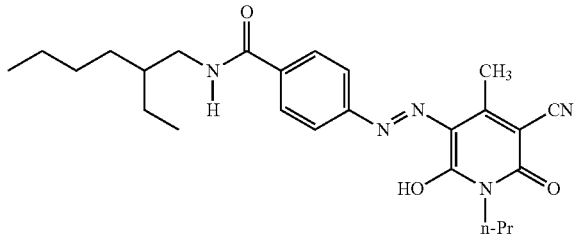

-continued
(1-39)
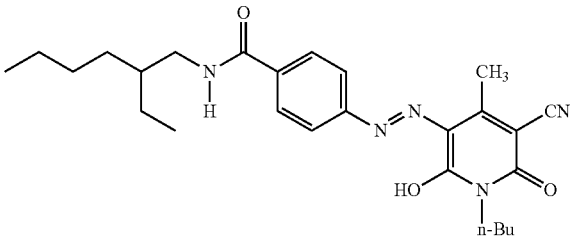
(1-41)
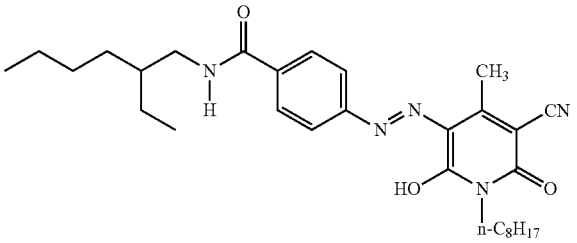
(1-47)
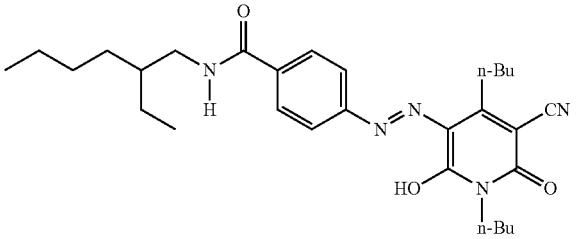
(1-50)
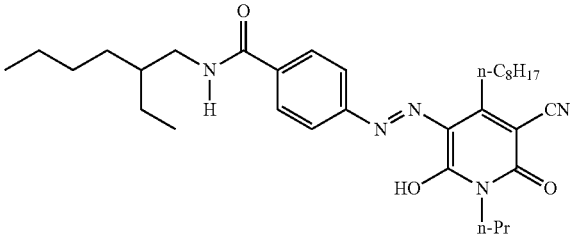
(2-26)
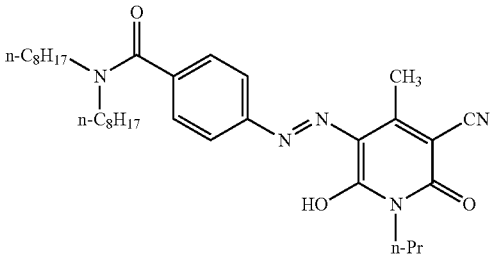
(2-27)
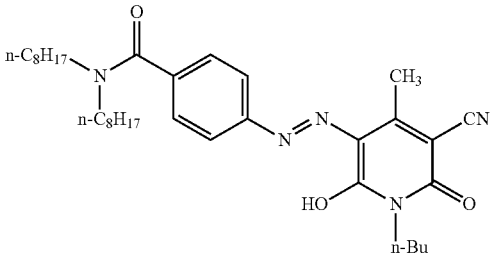
-continued
(2-30)
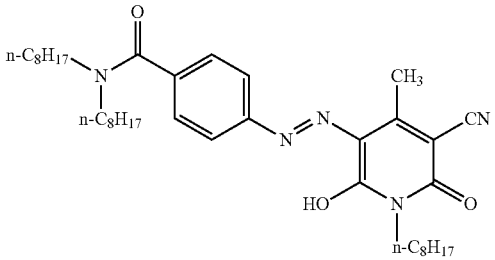
(2-38)
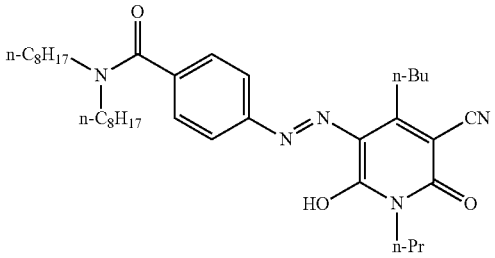
(2-39)
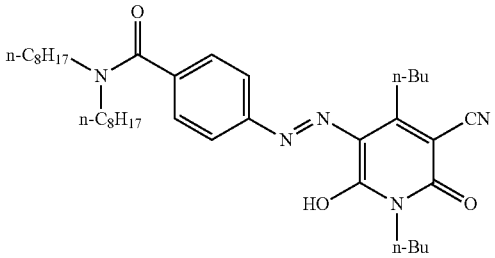
(2-40)
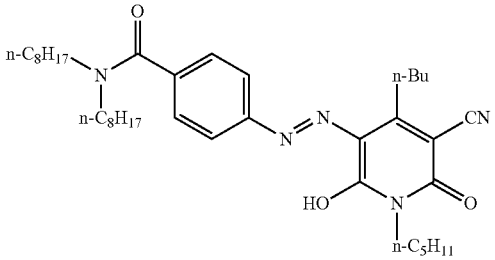
(2-42)
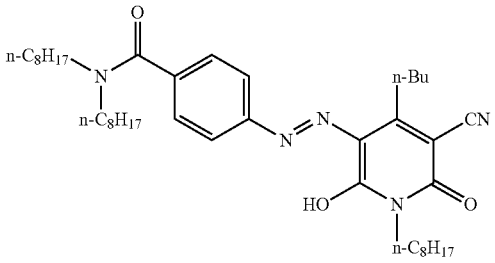

-continued
(2-49)
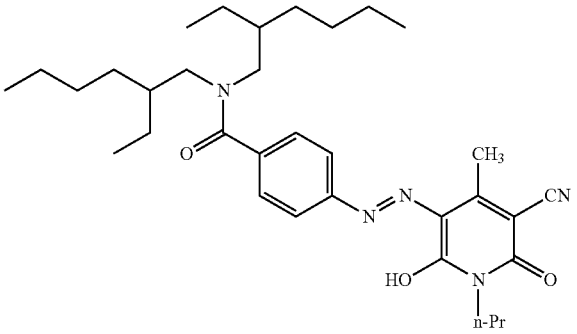
(2-50)
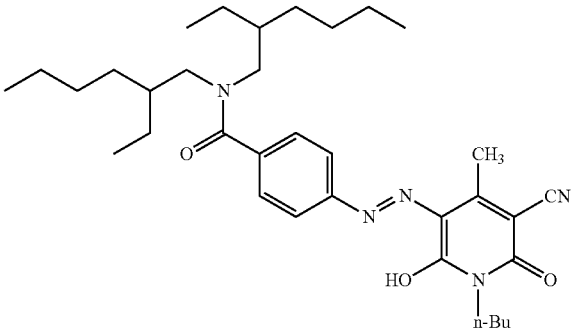
(2-51)
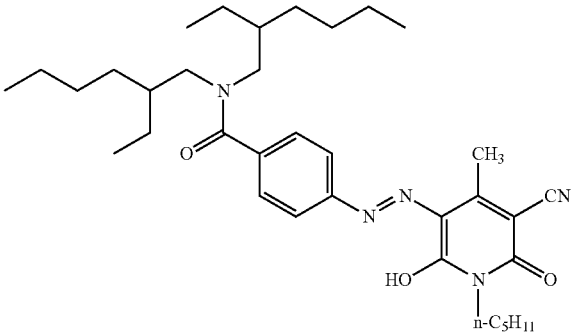
(2-52)
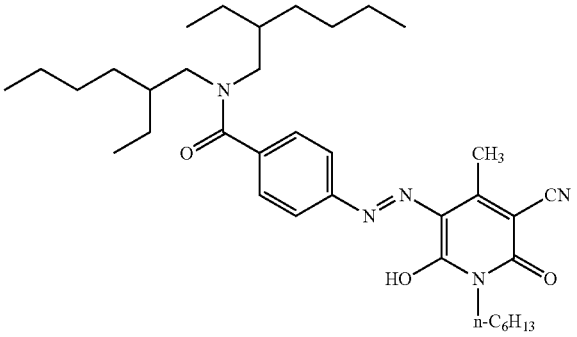
-continued
(2-53)
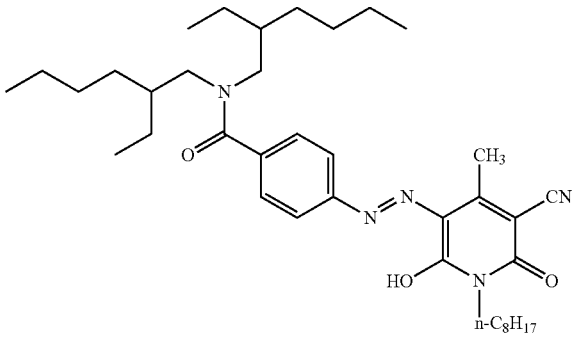
(3-42)
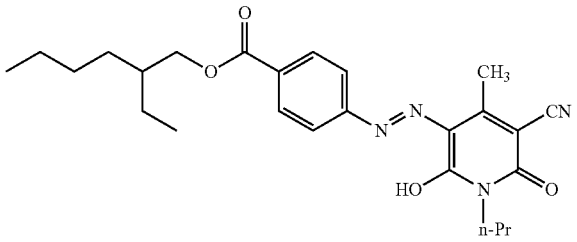
(3-43)
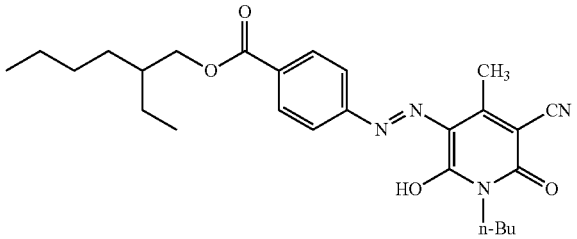
(3-44)
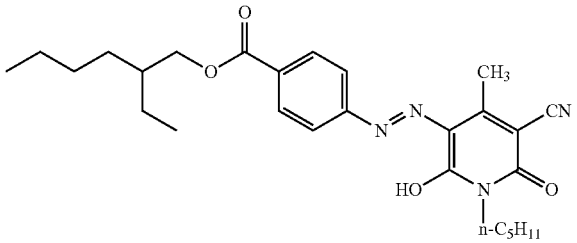
(3-45)
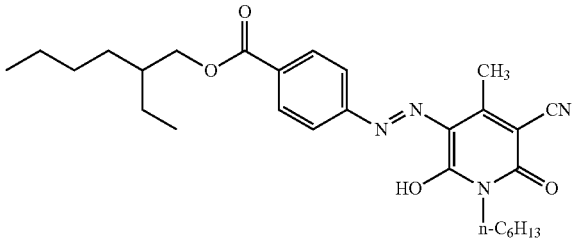

-continued (3-46)

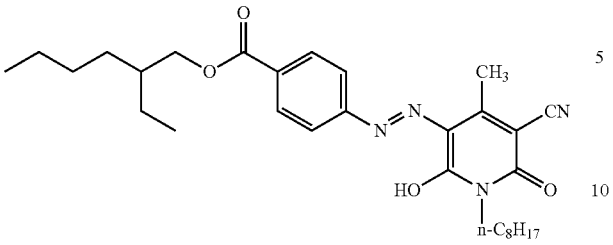

(3-52)

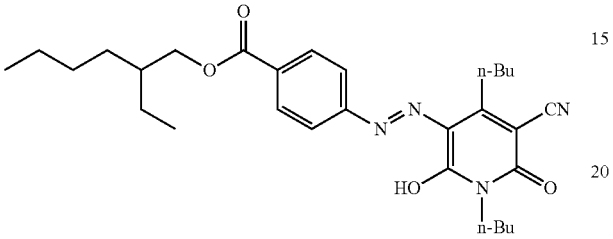

(3-54)

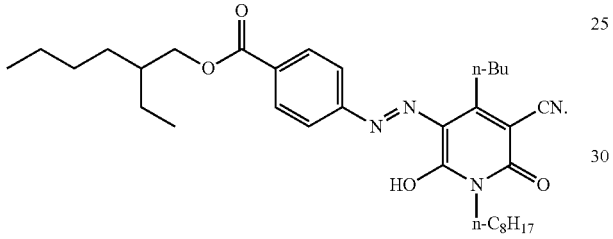

7. The yellow toner according to claim 1, wherein the toner particle further contains a wax.

8. A method for producing the yellow toner according to claim 1, the method comprising one of the following processes (i) and (ii):

(i) preparing a suspension by dispersing in an aqueous medium a polymerizable monomer composition containing the colorant and a polymerizable monomer capable of producing the binder resin, and polymerizing the polymerizable monomer to form the toner particle; and (ii) suspending a solution containing the colorant and the binder resin in an aqueous medium to prepare a suspension, and granulating the suspension to form the toner particle.

9. A method for producing the yellow toner according to claim 1, the method comprising:

mixing a dispersion liquid prepared by emulsifying the binder resin for dispersion and a dispersion liquid of the colorant; and forming the toner particle by aggregation and heat fusing.

10. A method for producing the yellow toner according to claim 1, the method comprising:

kneading a resin composition containing the binder resin and the colorant, and;

pulverizing the resin composition to form the toner particle.

* * * * *